US008651917B2

(12) United States Patent
Lopez et al.

(10) Patent No.: US 8,651,917 B2
(45) Date of Patent: Feb. 18, 2014

(54) FRONT CLOSURE BRA WITH CRISSCROSSING STRAPS

(76) Inventors: Angelica Lopez, Pismo Beach, CA (US); Richard Lopez, Pismo Beach, CA (US)

( * ) Notice: Subject to any disclaimer, the term of this patent is extended or adjusted under 35 U.S.C. 154(b) by 289 days.

(21) Appl. No.: 13/034,699

(22) Filed: Feb. 24, 2011

(65) Prior Publication Data

US 2012/0015586 A1 Jan. 19, 2012

Related U.S. Application Data

(63) Continuation-in-part of application No. 29/365,834, filed on Jul. 15, 2010, now Pat. No. Des. 655,069.

(51) Int. Cl.
*A41C 3/00* (2006.01)

(52) U.S. Cl.
USPC ..... 450/88; 450/79

(58) Field of Classification Search
USPC ..... 450/41, 58, 79, 80–83, 86, 88
See application file for complete search history.

(56) References Cited

U.S. PATENT DOCUMENTS

| | | | | |
|---|---|---|---|---|
| 1,705,113 A | | 3/1929 | Harvey | |
| 1,914,301 A | * | 6/1933 | Schottenfels | 450/83 |
| 1,923,821 A | | 8/1933 | Gudernan | |
| 2,156,478 A | | 5/1939 | Kemp | |
| 2,467,924 A | * | 4/1949 | Amyot | 450/41 |
| 2,468,622 A | * | 4/1949 | Glick | 450/41 |
| 2,501,325 A | | 3/1950 | Gates | |
| 2,537,831 A | | 1/1951 | Hunau | |
| 2,579,546 A | * | 12/1951 | Cadous | 450/41 |
| D165,851 S | | 2/1952 | Kaufman | |
| 2,679,646 A | | 6/1954 | Cousins | |
| 2,715,225 A | * | 8/1955 | Gould | 450/58 |
| 2,723,395 A | * | 11/1955 | Blatt | 450/60 |
| 2,782,418 A | | 2/1957 | Garson | |
| 2,839,063 A | | 6/1958 | Davis et al. | |
| 2,888,931 A | * | 6/1959 | Schaumer | 450/58 |
| 2,940,454 A | * | 6/1960 | Faron | 450/67 |
| 3,066,676 A | * | 12/1962 | Kaupp | 450/58 |
| 3,464,417 A | * | 9/1969 | Zucker | 450/5 |
| 4,300,568 A | | 11/1981 | Blanckmeister | |

(Continued)

OTHER PUBLICATIONS

Final Office Action for U.S. Appl. No. 29/365,834 mailed Jul. 14, 2011.

(Continued)

*Primary Examiner* — Gloria Hale
(74) *Attorney, Agent, or Firm* — Fitch, Even, Tabin & Flannery LLP

(57) ABSTRACT

A bra comprising a pair of breast cups, a front opening closure connected to the breast cups, a pair of generally triangular side panels, each of the generally triangular side panels containing vertical boning connecting each of the generally triangular side panels to a different breast cup; a pair of crisscrossing straps, each crisscrossing strap coupled to the top of the vertical boning on one generally triangular side panel and the bottom of the boning on an opposite generally triangular side panel.

36 Claims, 13 Drawing Sheets

(56) References Cited

U.S. PATENT DOCUMENTS

| | | | |
|---|---|---|---|
| 4,411,269 | A | 10/1983 | Weintraub |
| D355,294 | S | 2/1995 | Bussey et al. |
| D366,351 | S | 1/1996 | Winchell |
| 6,023,785 | A | 2/2000 | Johnson |
| 6,293,844 | B1 | 9/2001 | Dalton |
| D485,966 | S | 2/2004 | Flannery |
| 6,824,445 | B2 | 11/2004 | Oneyear et al. |
| 6,896,582 | B2 | 5/2005 | Kawami |
| D546,028 | S | 7/2007 | Lin |
| 7,240,371 | B2 | 7/2007 | Liu et al. |
| D562,528 | S | 2/2008 | Deal |
| D583,127 | S | 12/2008 | Deal |
| 7,553,213 | B2 | 6/2009 | Smith et al. |
| D597,278 | S | 8/2009 | Cavosie |
| 7,588,479 | B2 | 9/2009 | Falla |
| 7,806,748 | B2 | 10/2010 | Richardson |
| D655,069 | S | 3/2012 | Lopez et al. |
| D678,659 | S | 3/2013 | Lopez et al. |
| 2009/0233522 | A1 | 9/2009 | Schlatmann |
| 2011/0289646 | A1 | 12/2011 | Scozzafava |

OTHER PUBLICATIONS

Notice of Allowance for U.S. Appl. No. 29/365,834 mailed Oct. 20, 2011.

Ex Parte Quayle Action for U.S. Appl. No. 29/365,834 mailed Feb. 10, 2011.

Non Final Office Action for U.S. Appl. No. 29/365,834 mailed Oct. 22, 2010.

Lopez; U.S. Appl. No. 29/365,834, filed Jul. 15, 2010.

Lopez et al.; U.S. Appl. No. 29/412,891, filed Feb. 8, 2012.

Lopez et al.; U.S. Appl. No. 29/389,512, filed Apr. 12, 2011.

Non-final office action from U.S. Appl. No. 29/389,512 mailed Jul. 10, 2012 (7 pages).

Notice of Allowance and Fee(s) Due from U.S. Appl. No. 29/412,891 mailed Nov. 14, 2012 (12 pages).

Non-final office action from U.S. Appl. No. 29/389,512 mailed Nov. 16, 2012 (11 pages).

USPTO; Notice of Allowance issued in U.S. Appl. No. 29/389,512, mailed Apr. 19, 2013, 9 pages.

USPTO; Notice of Allowance issued in U.S. Appl. No. 29/389,512, mailed Sep. 10, 2013, 9 pages.

* cited by examiner

FRONT CLOSURE BRA WITH CRISSCROSSING STRAPS

This application is a continuation-in-part of U.S. patent application Ser. No. 29/365,834 filed Jul. 15, 2010, Lopez et al., entitled STRAPLESS BRA, which is incorporated by reference in its entirety.

FIELD OF INVENTION

This invention relates to a brassiere or bra, and more specifically to a front closure bra with crisscrossing straps.

BACKGROUND

A bra is an undergarment that covers, supports and elevates breasts. Bras may also be worn to improve the perceived shape and size of the breasts, to restrain breast movement during exercise, for prosthetic purposes, or to facilitate nursing.

Typically, bras comprise a cup for each breast, a center panel (or gore), a band running around the torso under the breasts, side and back panels, hook and eye sets, and shoulder straps. The cups may be supported by underwires made of metal and sometimes coated in plastic. Underwire is often used in strapless bras to support the breasts. Wirefree bras support breasts using strengthened, larger cups and wider bands. These bras are sometimes referred to as softcup bras. Bras are usually fastened with a hook fastener on the band, typically at the back. A fastener may also be located in the front of a bra, between the cups. Bras may also be pulled on over a woman's head and have no fasteners. Bras may contain padding to improve comfort, conceal the nipples, or enhance bust size. Materials used often include a fabric such as cotton, polyester, Spandex or lace.

Many women find it difficult to locate a well-fitting and comfortable bra. Reasons why locating a well-fitting bra may be difficult include a wide variation in manufacturers' sizes, and a wide variation in the shape of women's bodies. An accurate bra fit is determined by correctly calculating the chest size (or band size) and breast volume (the cup size). The band size is typically adjusted using the two or three alternate sets of fastening hooks and eyes in the clasp. A set of two bra straps, typically over the shoulders, can usually also be adjusted slightly.

Wearing a bra which does not fit correctly may lead to a number of problems, including back pain, restricted breathing, abrasions, breast pain and poor posture. Back pain, neck pain and shoulder pain may be caused by a bra which causes the shoulders to support the majority of the weight of the chest. Typical designs may also constrict chest movement during breathing. In large-breasted women, wearing an improperly-fitted bra may result in maceration (loss of skin), chafing, intertrigo (rash), and fungal infections. Some women experience mastodynia or mastalgia (breast pain), particularly when performing strenuous physical activity or exercise. A properly fitted bra reduces such pain. Very large breasts can reduce the normal curve of the upper and mid-back region and may eventually lead to severe low back pain and poor posture.

SUMMARY OF THE PRESENT INVENTION

A bra comprising a pair of crisscrossing straps, each crisscrossing strap coupled to the top of an adjacent vertical boning and to the bottom of boning connected to an opposite breast cup is presented. The bra provides a pair of breast cups, a front opening closure connected to the breast cups, vertical boning connected to each breast cup, and a pair of crisscrossing straps. The crisscrossing straps are, in accordance with one embodiment, coupled by any suitable attachment means, including stitching and the use of a ring. The crisscrossing straps are, in some variations, adjustable by any suitable means, including a slider, hook and eye set, snap, button, and hook. The crisscrossing straps may also be, in some variations, made of elastic material to provide self adjustment. Shoulder straps may optionally be included. The shoulder straps may, in some variations, be adjustable, and may, in some variations, be removable, such as through the unhooking of suitable hooks.

In one embodiment, a pair of generally triangular side panels are provided in accordance with some embodiments. The side panels contain vertical boning connecting each of the side panels to a different breast cup. Each crisscrossing strap is coupled to the top of the vertical boning on one generally triangular side panel and the bottom of the boning on an opposite generally triangular side panel. Each crisscrossing strap is also coupled to the outside tip of a generally triangular side panel and to the boning on an opposite generally triangular side panel.

When, in accordance with the one embodiment, triangular-like side panels are provided, each crisscrossing strap is, in accordance with one variation, sewn into the length of the top of each generally triangular side panel. In addition, the bottom left generally triangular side panel is sewn slightly over the bottom left crisscrossing strap. In accordance with one variation, the bottom left generally triangular side panel is sewn completely over the bottom left crisscrossing strap. The bottom right crisscrossing strap is sewn over the bottom right generally triangular side panel.

DETAILED DESCRIPTION OF THE PREFERRED EMBODIMENTS

There is a need for front closure bras with crisscross straps, which provide a large range of adjustment and the ability to separately adjust the fit of the straps and cup so as to provide a close fit to a large range of body types.

In accordance with some embodiments, a bra having the ability to adjust the size of a strap and the fit of the cup separately is provided.

In accordance with some variations, a bra having a large range of adjustment is provided.

In accordance with some variations, a front closure bra including adjustment in the back of the bra and the ability to provide a close fit to a large range of women is provided.

In accordance with some variations, a bra having a criss-cross "X" design in the back, allowing for a better fit and less slippage from the body is provided.

In accordance with some variations, a strapless bra providing a non-slipping fit without the use of shoulder straps is provided.

Figure 1:
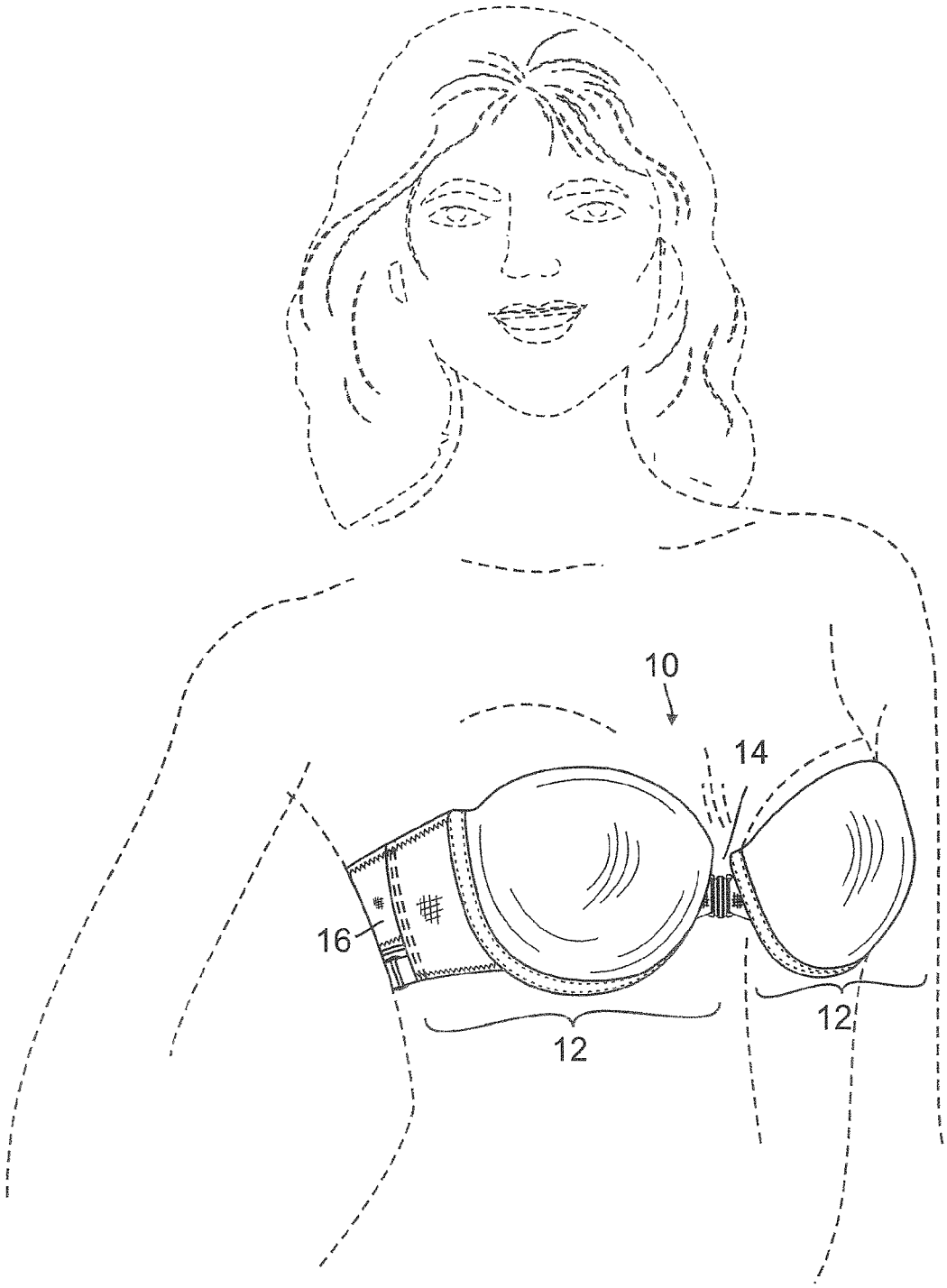
FIG. 1 is a front perspective view of a bra according to an embodiment of the present invention.

Referring now to FIG. 1, shown is a front perspective view of a bra 10, including a pair of breast cups 12, a front opening closure 14 and a pair of generally triangular side panels 16.

The pair of breast cups 12 are attached to the front opening closure 14 and coupled to the generally triangular side panels 16.

In operation, the breast cups 12 receive the breasts, the front opening closure 14 allows the bra to be fastened together in the front of the body, and the generally triangular side panels 16 provide for support around the back.

Figure 2:
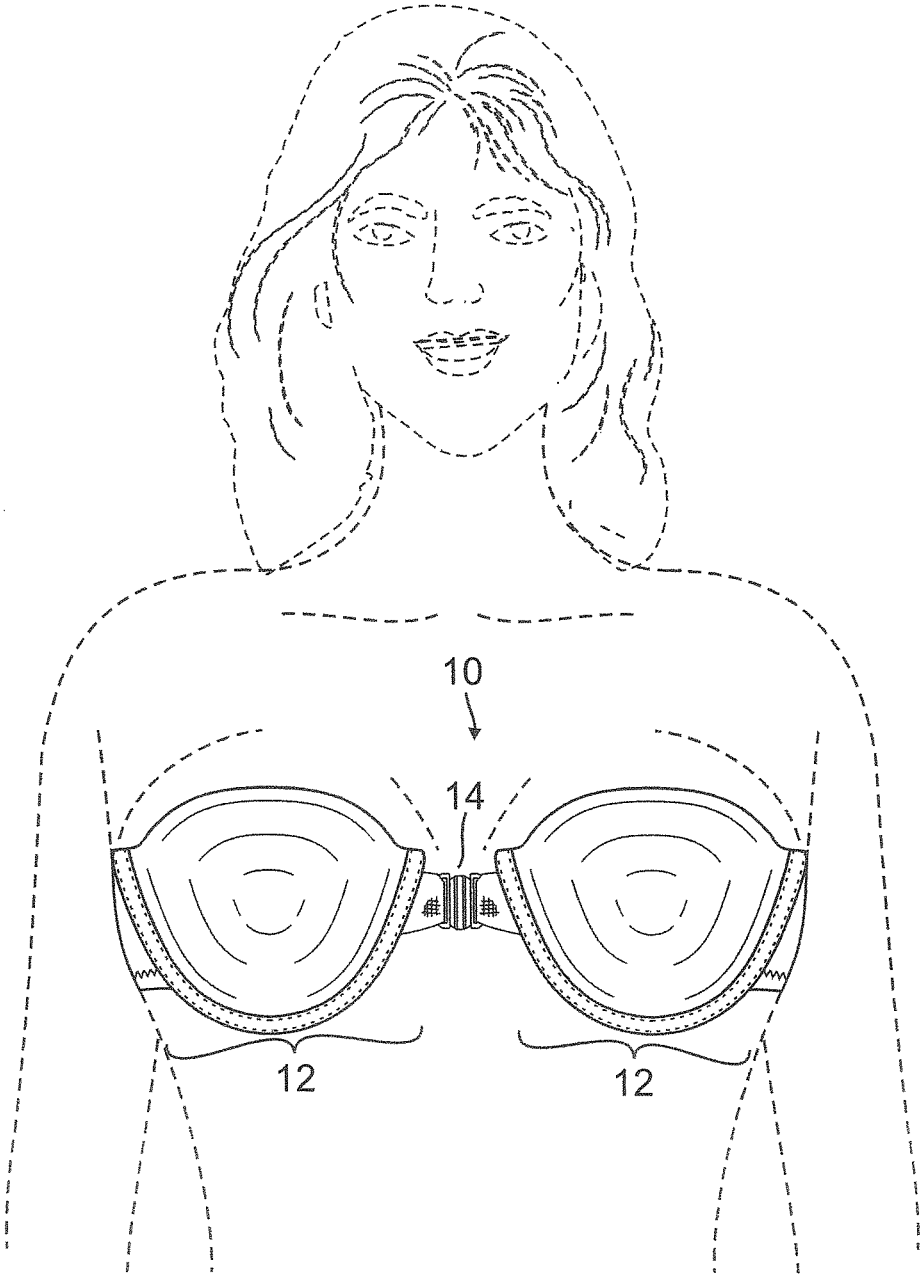
FIG. 2 is a front-elevational view of the bra of FIG. 1 according to an embodiment of the present invention.

Referring to FIG. 2, shown is a front-elevational view of the bra 10 of FIG. 1.

Figure 3:
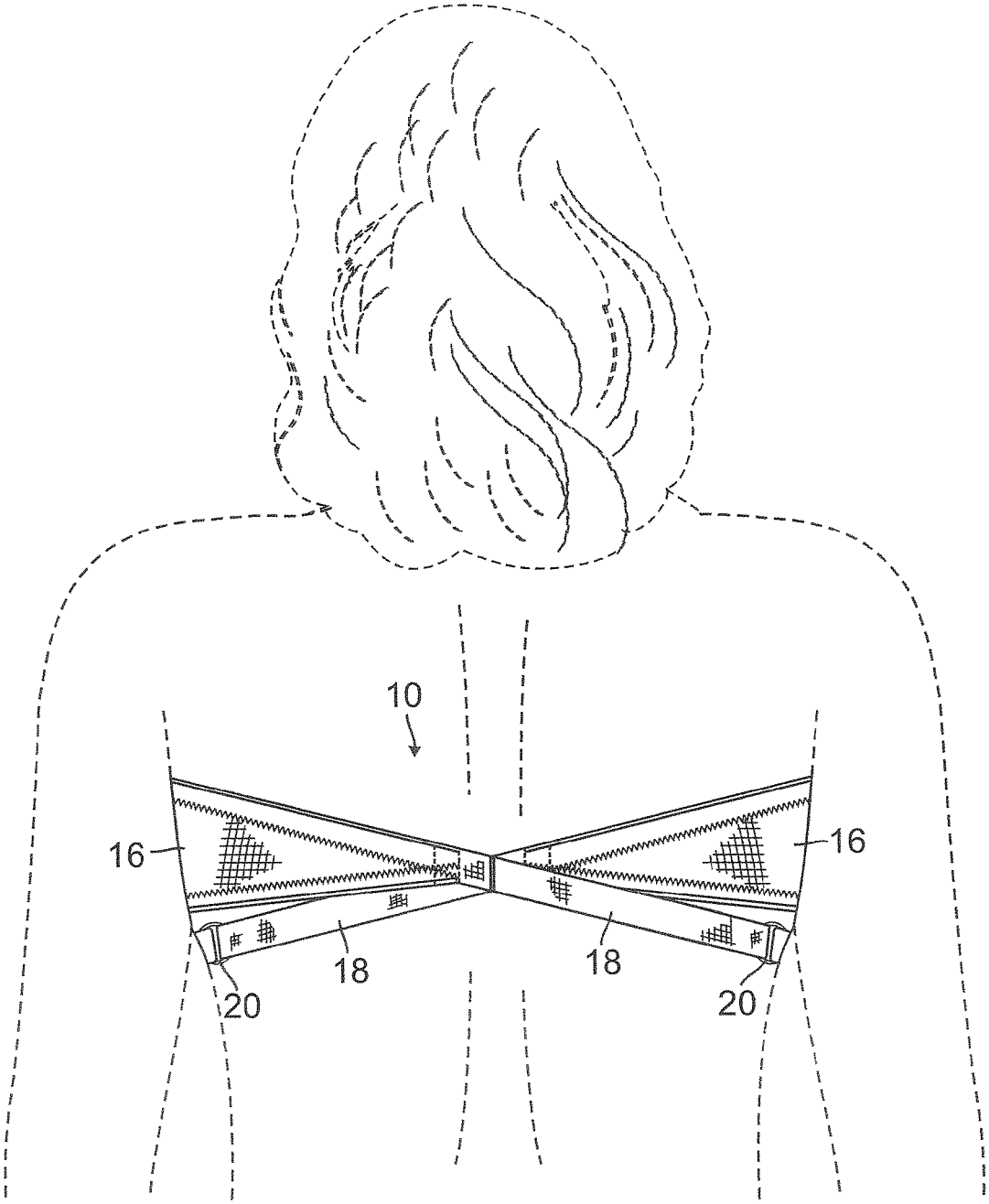
FIG. 3 is a rear elevational view of the bra of FIG. 1 according to an embodiment of the present invention.

Referring to FIG. 3, shown is a rear elevational view of the bra 10, showing a pair of generally triangular side panels 16, a pair of crisscrossing straps 18, and sliders 20.

The generally triangular side panels 16 are coupled to the breast cups 12. Each of the crisscrossing straps 18 is coupled to the top of an adjacent vertical boning on each breast cup 12 and to the bottom of boning connected to an opposite breast cup 12. The top of each of the generally triangular (triangular-like) side panels 16 is sewn to the top of each crisscrossing strap 18. A slider 20 is located along each of the crisscrossing straps 18.

In operation, the generally triangular (triangular-like) side panels 16 provide support along the back in conjunction with the crisscrossing straps 18. The length of the crisscrossing straps may be adjusted by the slider 20.

Figure 4:
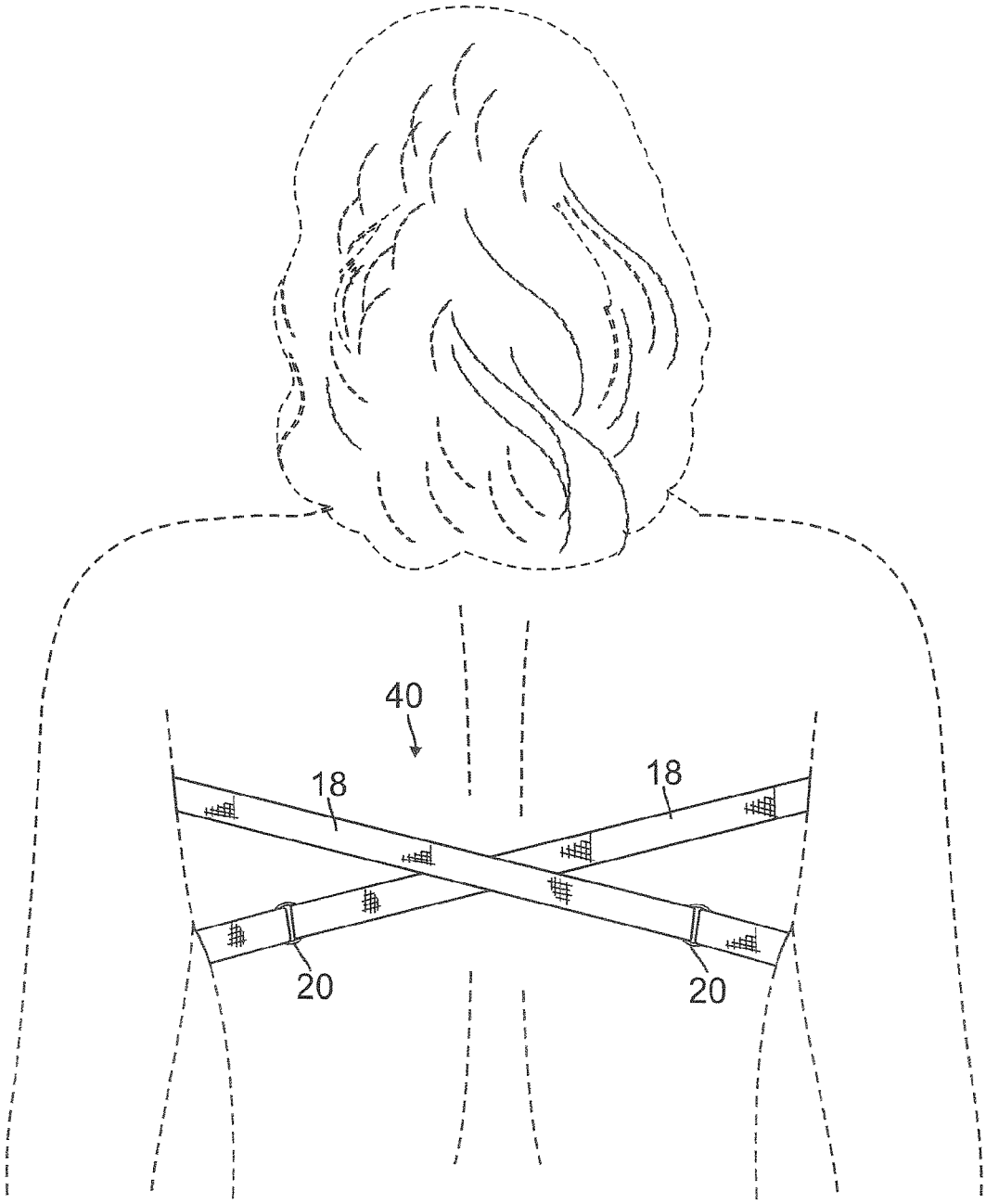
FIG. 4 is a rear elevational view of a bra according to an embodiment of the present invention.

Referring to FIG. 4, shown is a rear elevation view of a bra 40 including crisscrossing straps 18 and sliders 20.

The crisscrossing straps 18 are coupled to the top of the adjacent breast cup 12 and to the bottom of an opposite breast cup 12. A slider 20 is located along each of the crisscrossing straps 18.

In operation, the crisscrossing straps 18 provide support along the back. The length of the crisscrossing straps may be adjusted by the slider 20.

Figure 5:
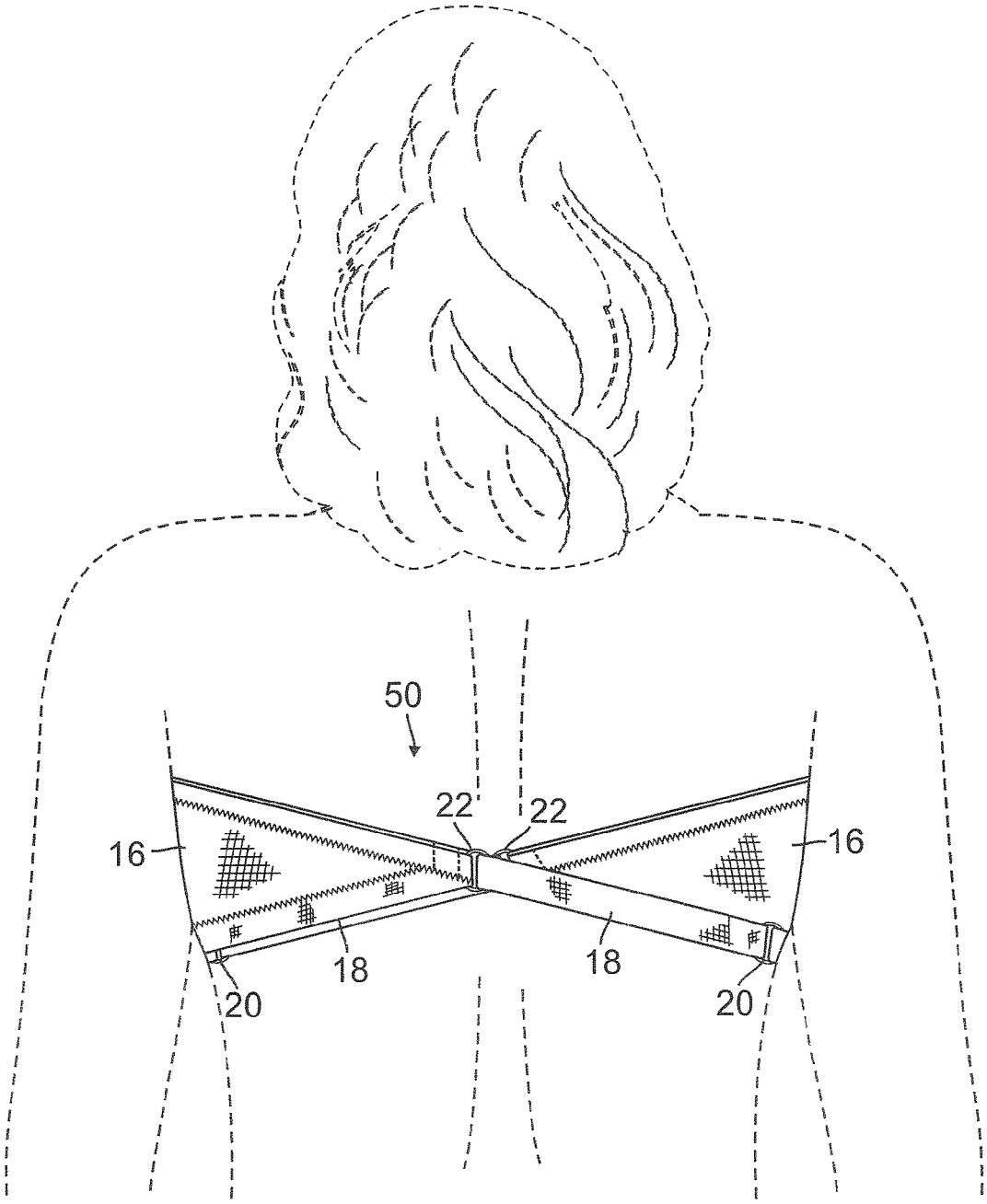
FIG. 5 is a rear elevational view of a bra according to an embodiment of the present invention.

Referring to FIG. 5, shown is a rear elevational view of a bra 50, showing a pair of generally triangular (triangular-like) side panels 16, a pair of crisscrossing straps 18, sliders 20, and rings 22.

The generally triangular (triangular-like) side panels 16 are coupled to the breast cups 12. A slider 20 is located along each of the crisscrossing straps 18. The bottom left generally triangular (triangular-like) side panel 16 is sewn slightly over the bottom left crisscrossing strap 18. The bottom right criss-crossing strap 18 is sewn over the bottom right generally triangular (triangular-like) side panel 16. The use of rings allows for each of the crisscrossing straps 18 to be attached in two separate sections. Each crisscrossing strap 18 is coupled to the outside tip of a generally triangular (triangular-like) side panel 16 by use of a ring 22.

In operation, the generally triangular (triangular-like) side panels 16 provide support along the back in conjunction with the crisscrossing straps 18. The length of the crisscrossing straps may be adjusted by the slider 20. The sewing together of the crisscrossing straps 18 and the generally triangular (triangular-like) side panels 16 prevents the bra from becoming tangled and provides for greater support.

Figure 6:
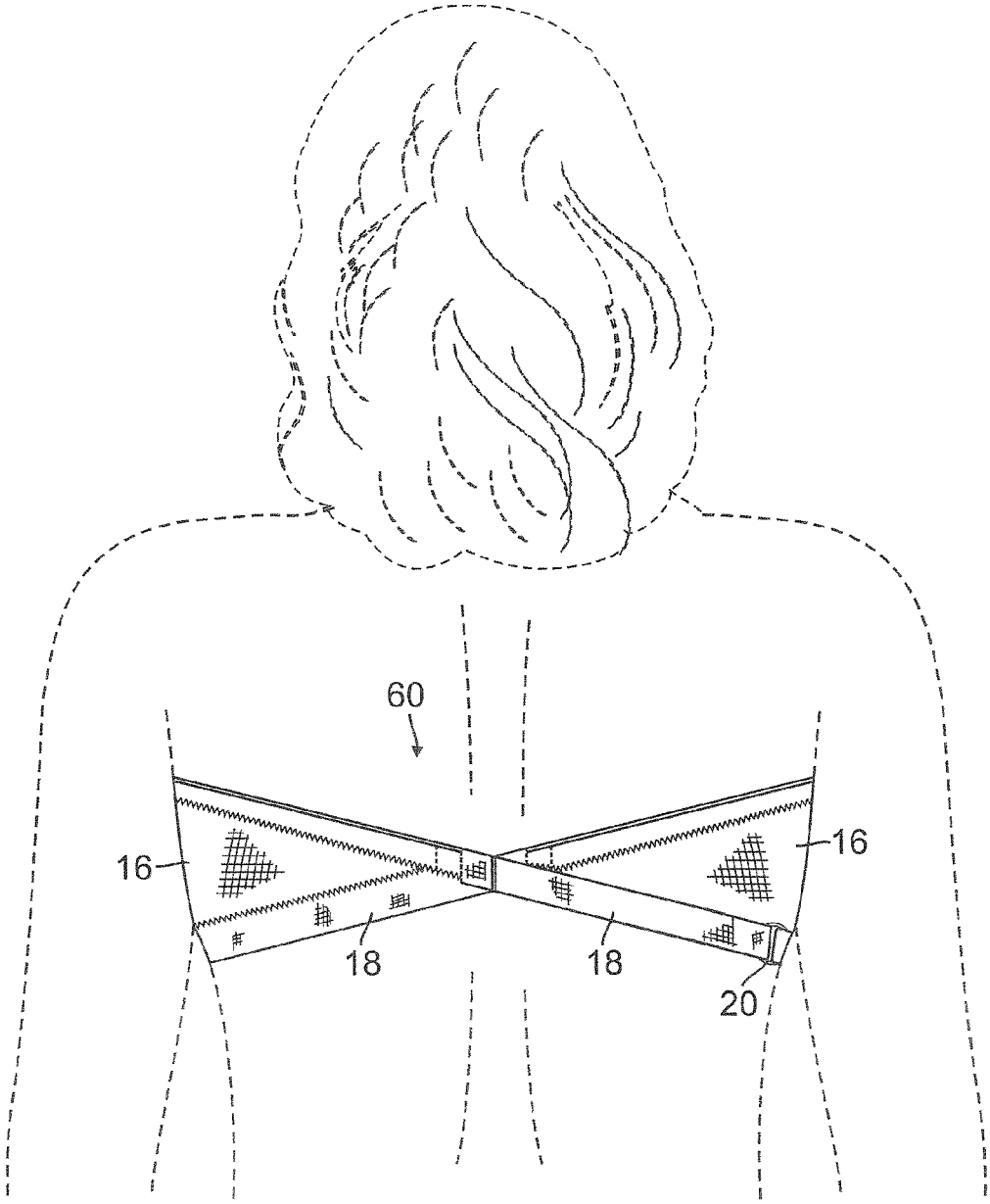
FIG. 6 is a rear elevational view of a bra according to an embodiment of the present invention.

Referring to FIG. 6, shown is a rear elevational view of a bra 60, showing a pair of generally triangular (triangular-like) side panels 16, a pair of crisscrossing straps 18, and sliders 20.

The generally triangular (triangular-like) side panels 16 are coupled to the breast cups 12. Each of the crisscrossing straps 18 is coupled to the top of a generally triangular (triangular-like) side panel 16 and the bottom of the opposite generally triangular (triangular-like) side panel 16. The top of each of the generally triangular (triangular-like) side panel 16 is sewn to the top of each crisscrossing strap 18. A slider 20 is located along each of the crisscrossing straps 18. The bottom left generally triangular (triangular-like) side panel 16 is sewn completely over the bottom left crisscrossing strap 18. The bottom right crisscrossing strap 18 is sewn over the bottom right generally triangular (triangular-like) side panel 16.

In operation, the generally triangular (triangular-like) side panels 16 provide support along the back in conjunction with the crisscrossing straps 18. The length of the crisscrossing straps may be adjusted by the slider 20. The sewing together of the crisscrossing straps 18 and the generally triangular (triangular-like) side panels 16 prevents the bra from becoming tangled and provides for greater support.

Figure 7:
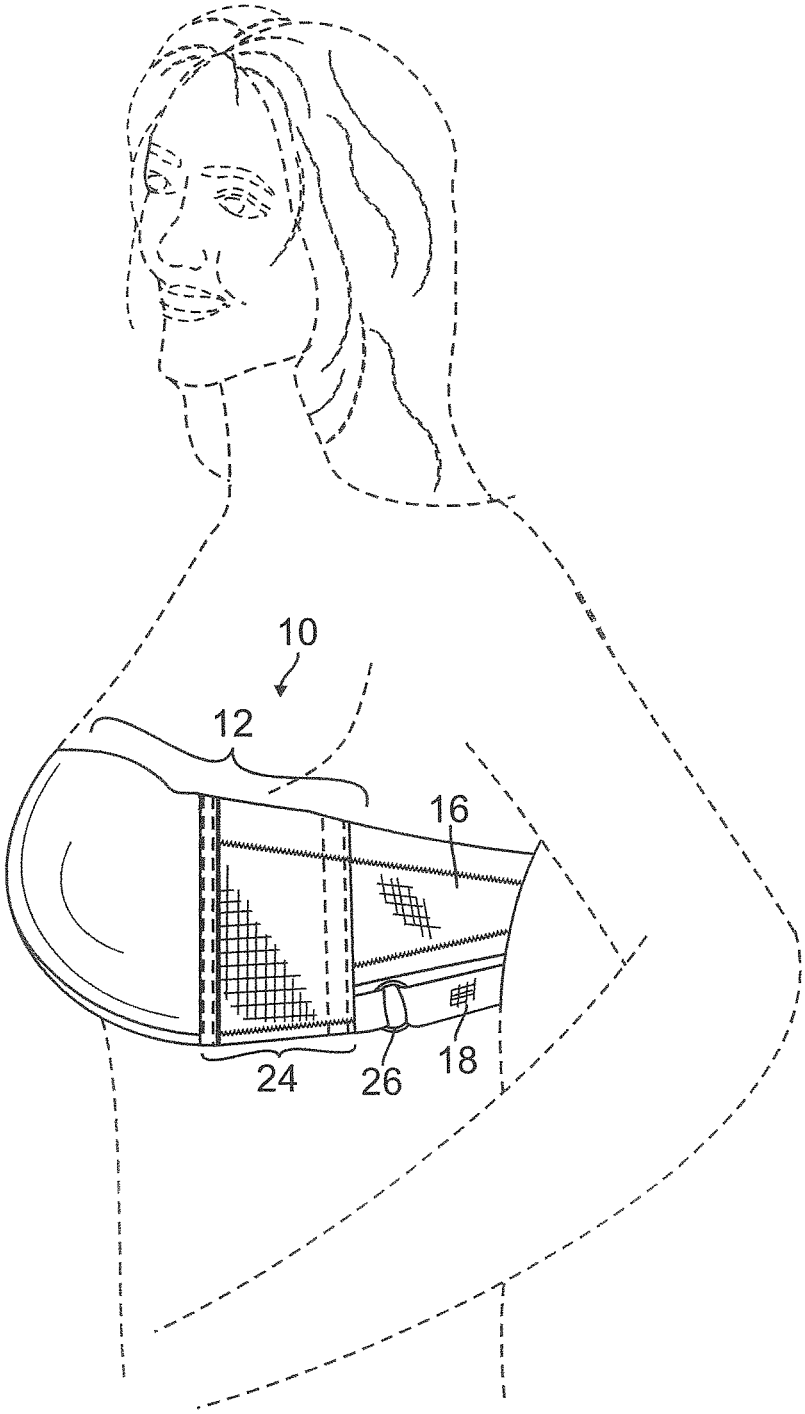
FIG. 7 is a right side elevational view of the bra of FIG. 1 according to an embodiment of the present invention.

Referring to FIG. 7, shown is a right side elevation view of the bra 10 of FIG. 1. Shown is a breast cup 12 including a breast cup panel 24, a generally triangular (triangular-like) side panel 16, a crisscrossing strap 18 and ring 26.

The breast cup panel 24 is included in the breast cup 12 and is coupled to the generally triangular (triangular-like) side panel 16. Each of the crisscrossing straps 18 is coupled to the top of an adjacent vertical boning on each breast cup 12 and to the bottom of boning connected to an opposite breast cup 12 by stitching and a ring 26. The top of each of the generally triangular (triangular-like) side panels 16 is sewn to the top of each crisscrossing strap 18. A slider 20 is located along each of the crisscrossing straps 18.

In operation, the breast cup panel 24 of the breast cup 12 provides extra support around the breast. The generally triangular (triangular-like) side panels 16 provide support along the back in conjunction with the crisscrossing straps 18.

Figure 8:
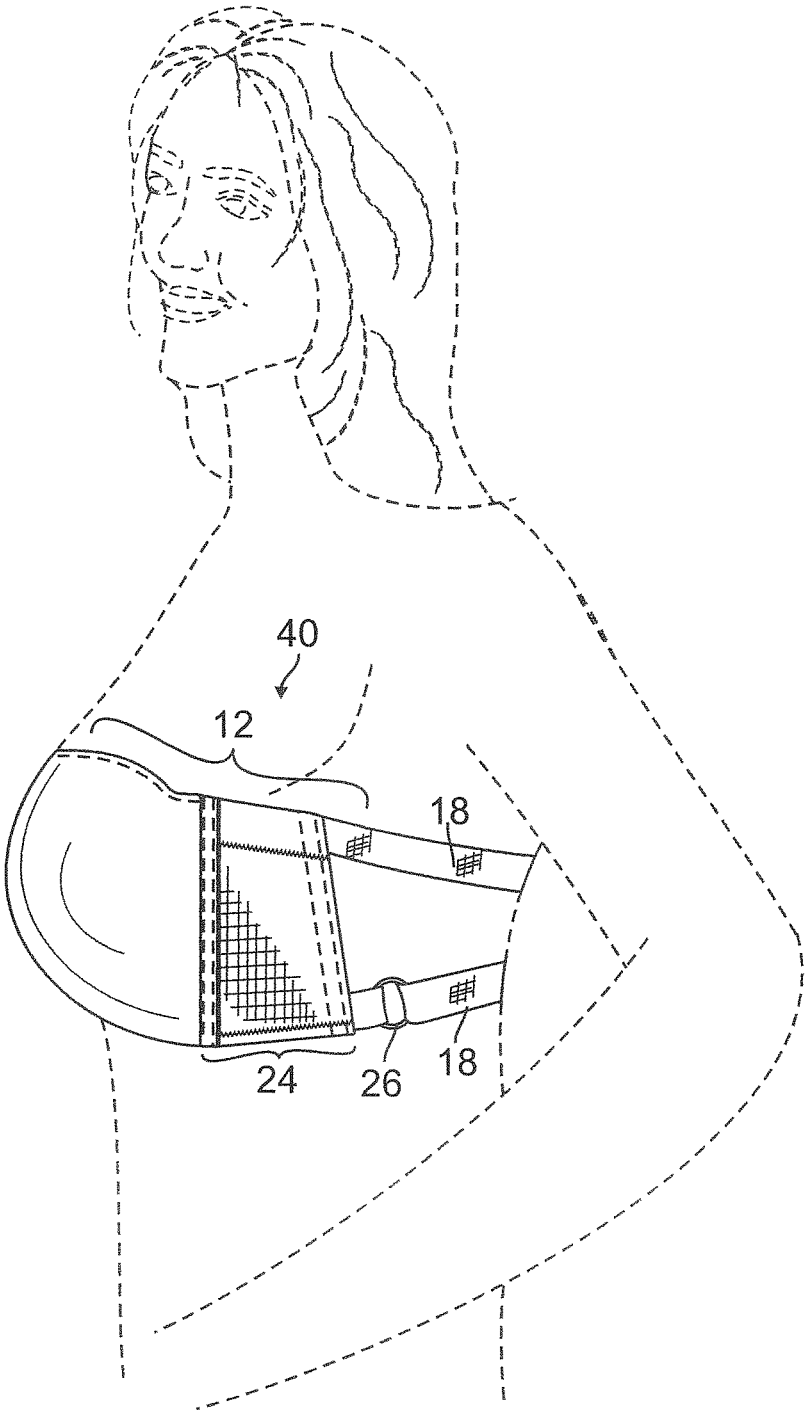
FIG. 8 is a right side elevational view of the bra of FIG. 4 according to an embodiment of the present invention.

Referring to FIG. 8, shown is a right side elevational view of the bra 40 of FIG. 4. Shown is a breast cup 12 including a breast cup panel 24, a crisscrossing strap 18 and ring 26.

The crisscrossing straps 18 are coupled to the top of breast cup panel 24 of the adjacent breast cup 12 by sewing and to the bottom of an opposite breast cup panel 24 of the breast cup 12 by a ring 26. A slider 20 is located along each of the crisscrossing straps 18.

In operation, the crisscrossing straps 18 provide support along the back. The length of the crisscrossing straps may be adjusted by the slider 20.

Figure 9:
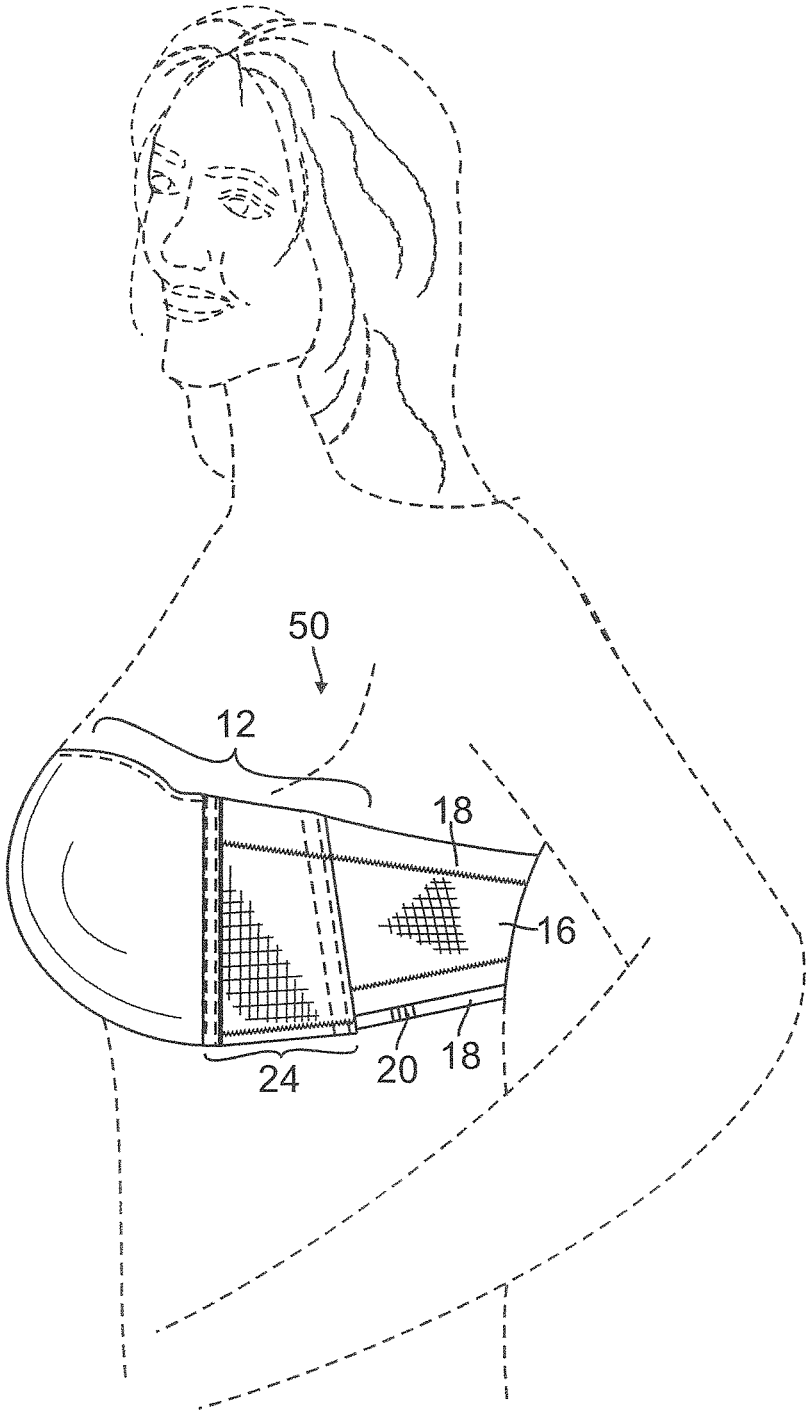
FIG. 9 is a right side elevational view of the bra of FIG. 5 according to an embodiment of the present invention.

Referring to FIG. 9, shown is a right side elevational view of the bra 50 of FIG. 5. Shown is a breast cup 12 including a breast cup panel 24, a general triangular (triangular-like) side panel 16, crisscrossing straps 18 and slider 20.

Figure 10:
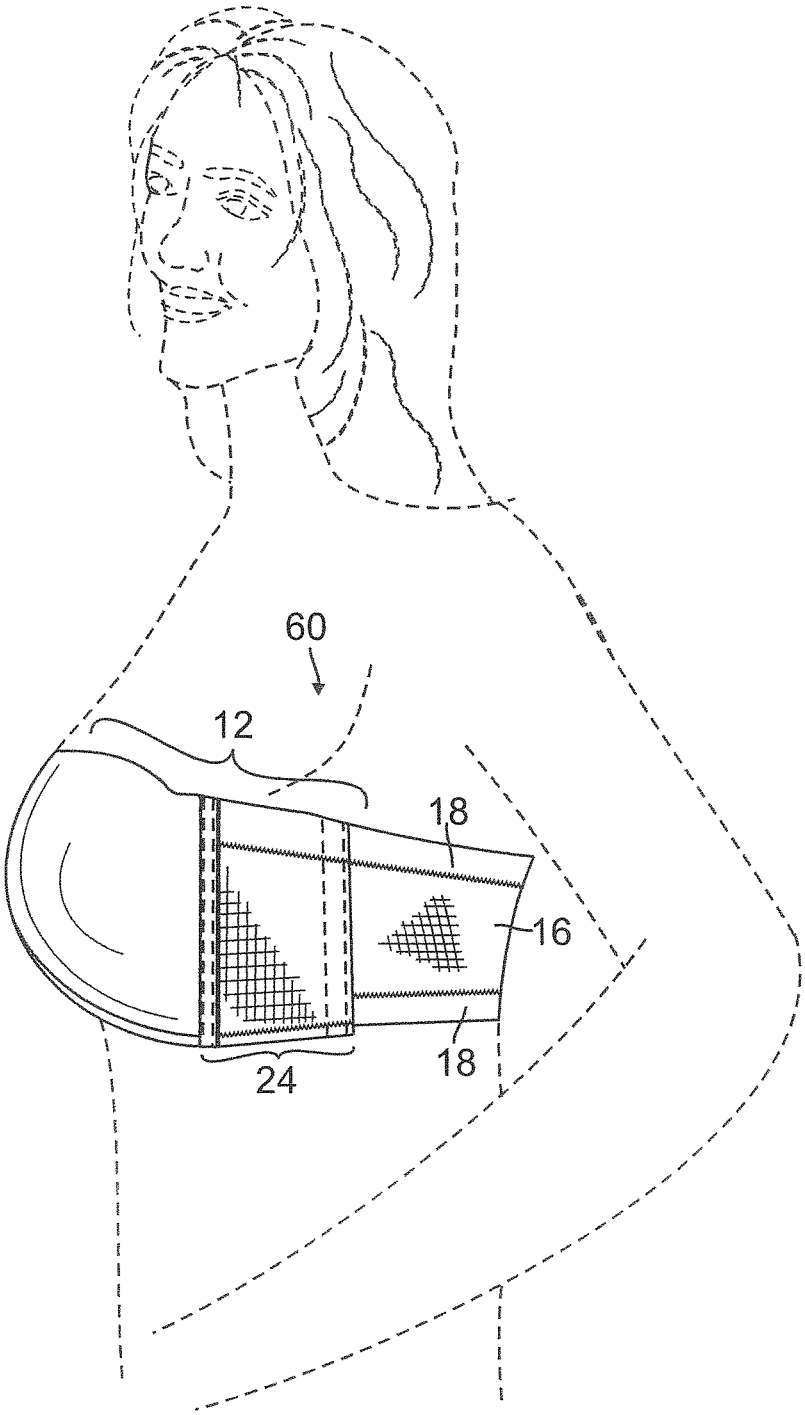
FIG. 10 is a right side elevational view of the bra of FIG. 6 according to an embodiment of the present invention.

Referring to FIG. 10, shown is a right side elevational view of the bra 60 of FIG. 6. Shown is a breast cup 12 including a breast cup panel 24, a general triangular (triangular-like) side panel 16 and crisscrossing straps 18.

Figure 11:
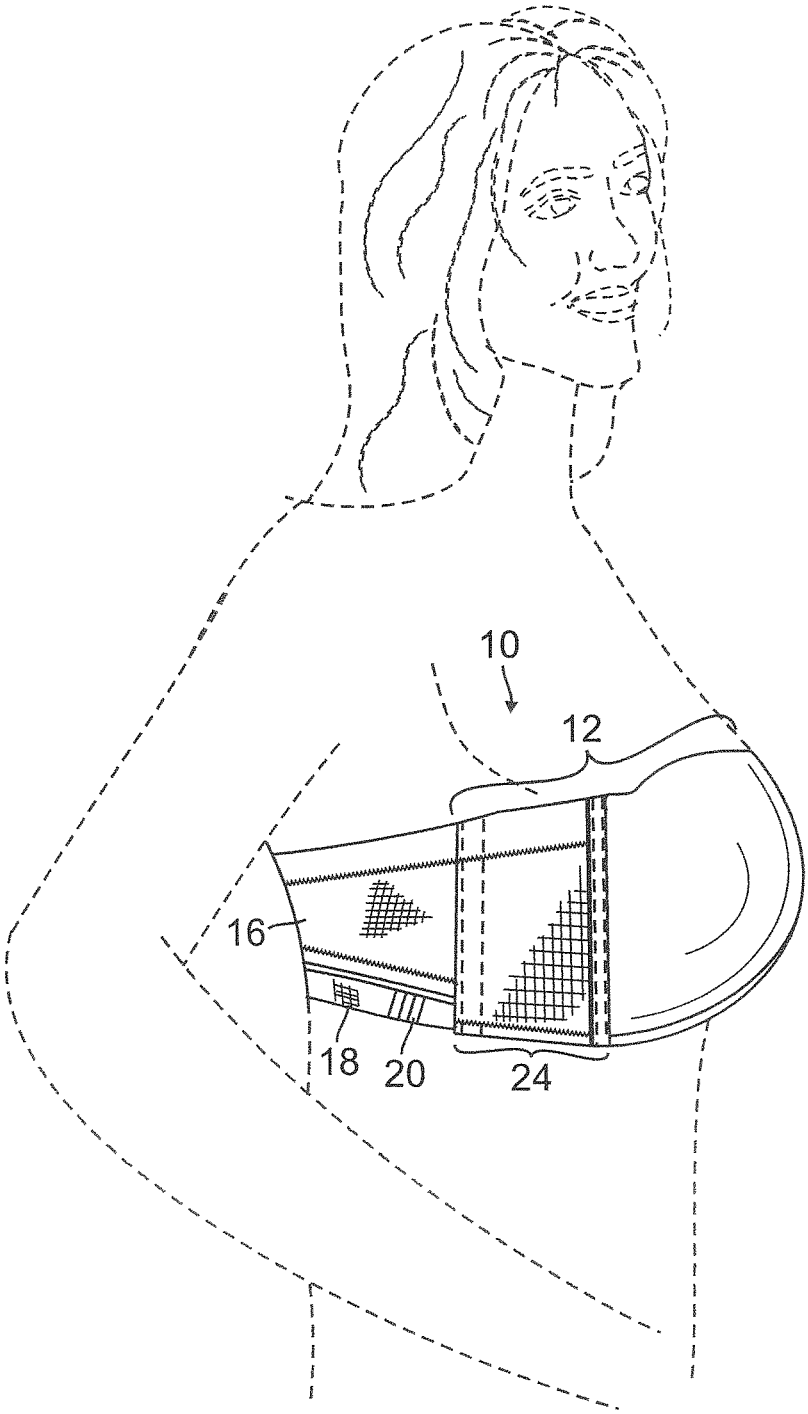
FIG. 11 is a left side elevational view of the bra of FIG. 1 according to an embodiment of the present invention.

Referring to FIG. 11, shown is a left side elevational view of the 10 bra of FIG. 1. Shown is a breast cup 12 including a breast cup panel 24, a generally triangular (triangular-like) side panel 16, crisscrossing straps 18 and slider 20.

Figure 12:
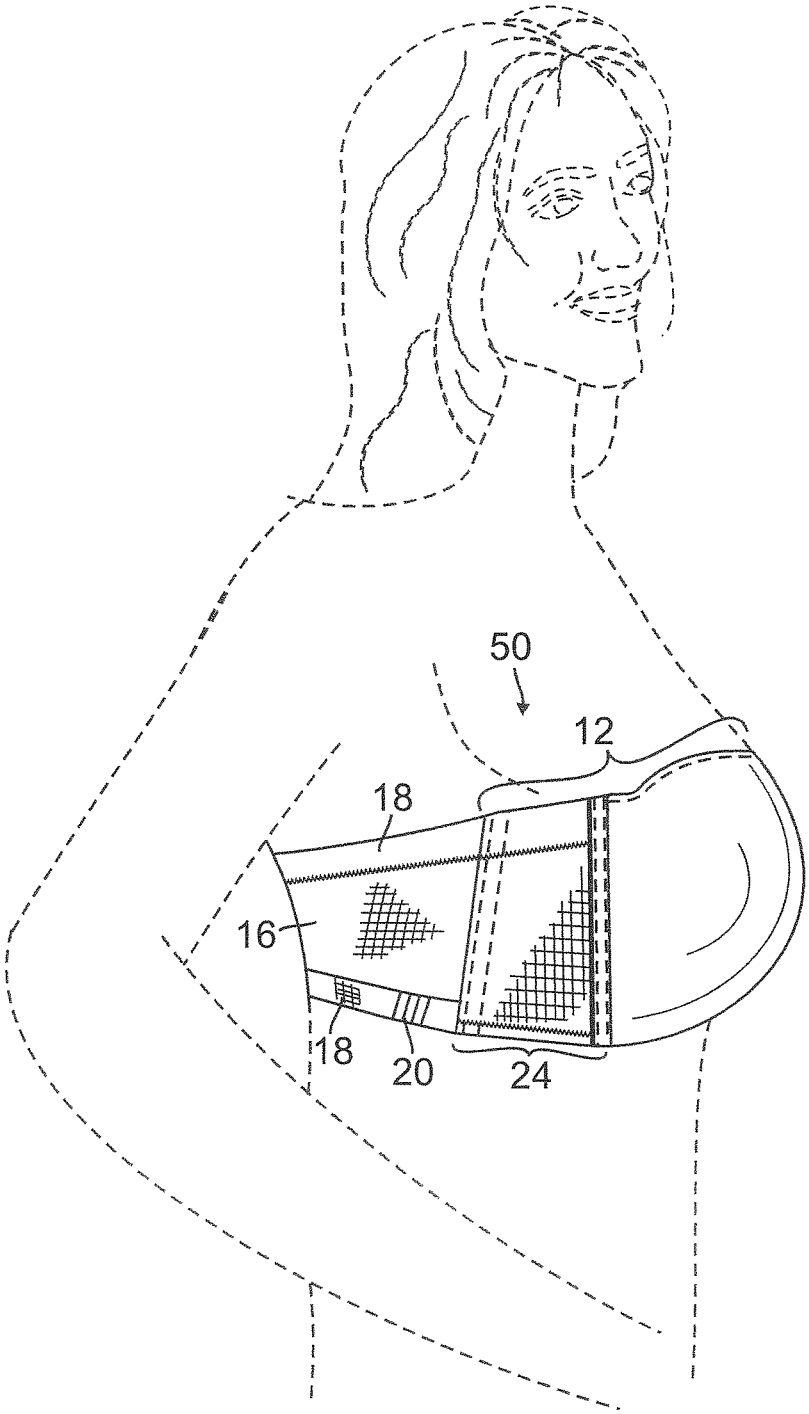
FIG. 12 is a left side elevational view of the bras of FIGS. 5 and 6 according to an embodiment of the present invention.

Referring to FIG. 12, shown is a left side elevational view of bras 50 and 60 of FIGS. 5 and 6. Shown is a breast cup 12 including a breast cup panel 24, a generally triangular (triangular-like) side panel 16, crisscrossing straps 18 and slider 20.

Figure 13:
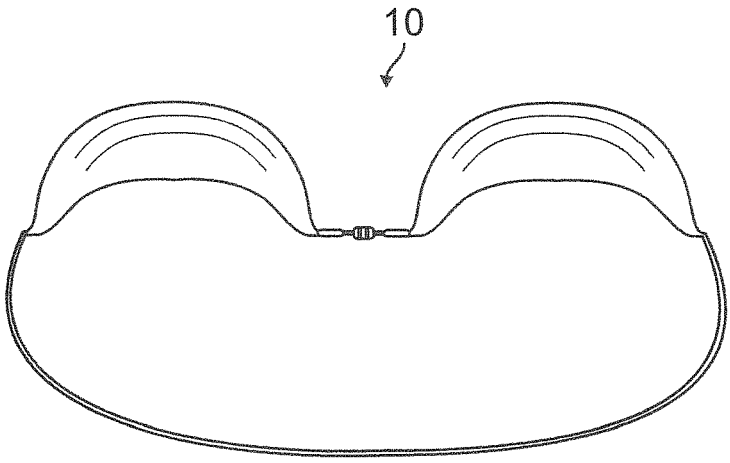
FIG. 13 is a top plan view of the bras of FIGS. 1, 4, 5 and 6 according to an embodiment of the present invention.

Referring to FIG. 13, shown is a top plan view of the bras of FIGS. 1, 4, 5 and 6.

Figure 14:
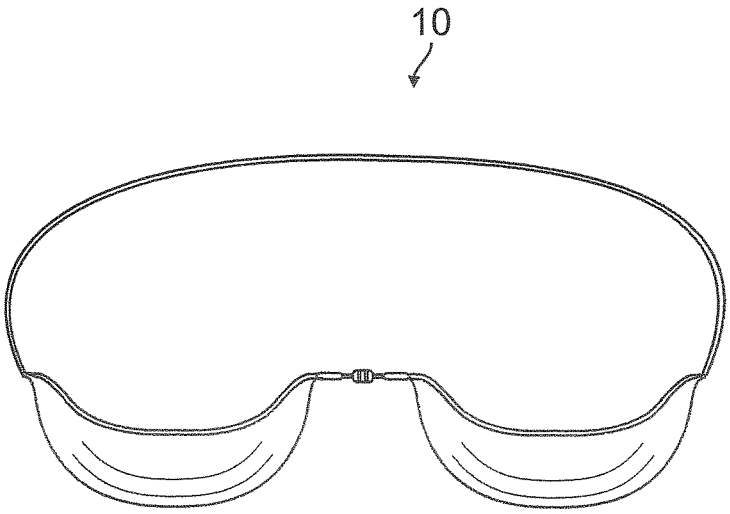
FIG. 14 is a bottom plan view of the bras of FIGS. 1, 4, 5 and 6 according to an embodiment of the present invention.

Referring to FIG. 14, shown is a bottom plan view of the bras of FIGS. 1, 4, 5 and 6.

While the invention has been described in detail with reference to preferred embodiments, it is understood that variations and modifications thereof may be made without departing from the true spirit and scope of the invention.

What is claimed is:

1. A bra comprising:

a pair of breast cups each comprising a breast cup panel;

a front opening closure connected to the breast cups;

a pair of generally triangular side panels, each of the side panels coupled to a breast cup panel connecting each of the side panels to a different breast cup; and a pair of crisscrossing straps, each crisscrossing strap coupled to a top portion of the a first breast cup panel coupled to one generally triangular side panel and to a bottom portion of a second breast cup panel coupled to an opposite generally triangular side panel.

2. The bra according to claim 1, wherein each of the crisscrossing straps is coupled to at least one of the first and second breast cup panels by stitching.

3. The bra according to claim 1, wherein each of the crisscrossing straps is coupled to at least one of the first and second breast cup panels by at least one ring.

4. The bra according to claim 1, wherein the each crisscrossing strap is sewn into a top side of one generally triangular side panel.

5. The bra according to claim 1, wherein the bottom left generally triangular side panel is sewn slightly over the bottom left crisscrossing strap.

6. The bra according to claim 1, wherein the bottom right crisscrossing strap is sewn over the bottom right generally triangular side panel.

7. The bra according to claim 1, wherein the bottom left generally triangular side panel is sewn completely over the bottom left crisscrossing strap.

8. The bra according to claim 1, wherein each of the crisscrossing straps is adjustable by use of at least one slider.

9. The bra according to claim 1, wherein each of the crisscrossing straps is adjustable by use of at least one hook and eye set.

10. The bra according to claim 1, wherein each of the crisscrossing straps is adjustable by use of at least one snap.

11. The bra according to claim 1, wherein each of the crisscrossing straps is adjustable by use of at least one button.

12. The bra according to claim 1, wherein each of the crisscrossing straps is adjustable by use of at least one hook.

13. The bra according to claim 1, further comprising a pair of shoulder straps.

14. The bra according to claim 13, wherein each of the pair of shoulder straps is attached to a top side of a generally triangular side panel by a hook and to the breast cup on the corresponding side by a different hook.

15. The bra according to claim 13, wherein each of the pair of shoulder straps is adjustable.

16. A bra comprising:

a pair a breast cups each comprising a breast cup panel;

a front opening closure connected to the breast cups;

a pair of generally triangular side panels, each of the generally triangular side panels coupled to a breast cup panel connecting each of the generally triangular side panels to a different breast cup; and a pair of crisscrossing straps, each crisscrossing strap coupled to an outside tip of a generally triangular side panel and to the breast cup panel coupled to an opposite generally triangular side panel.

17. The bra according to claim 16, wherein each of the crisscrossing straps is coupled to the outside tip of one of the generally triangular side panel by use of a ring and to the breast cup panel coupled to an opposite generally triangular side panel by stitching.

18. The bra according to claim 16, wherein each of the crisscrossing straps is coupled to the outside tip of one of the generally triangular side panel by use of stitching and to the breast cup panel coupled to an opposite generally triangular panel by stitching.

19. The bra according to claim 16, wherein each of the crisscrossing straps is adjustable by use of at least one slider.

20. The bra according to claim 16, wherein each of the crisscrossing straps is adjustable by use of at least one hook and eye set.

21. The bra according to claim 16, wherein each of the crisscrossing straps is adjustable by use of at least one snap.

22. The bra according to claim 16, wherein each of the crisscrossing straps is adjustable by use of at least one button.

23. The bra according to claim 16, further comprising a pair of shoulder straps.

24. The bra according to claim 23, wherein each of the pair of shoulder straps is attached to a top portion of a generally triangular side panel by a hook and the breast cup on the corresponding side by a different hook.

25. The bra according to claim 23, wherein each of the pair of shoulder straps is adjustable.

26. The bra according to claim 23, wherein the pair of shoulder straps are crisscrossing and attached to each of the generally triangular side panels by generally triangular back panels coupled to the generally triangular side panels, each of the pair of shoulder straps coupled to a top side of the generally triangular back panel by stitching and to a top portion of an opposite breast cup by a hook.

27. A bra comprising:

a pair of breast cups;

a front opening closure connected to the breast cups;

a pair of breast cup panels each connected to a breast cup; and a pair of crisscrossing straps, each crisscrossing strap coupled to a top portion of an adjacent breast cup panel and to a bottom portion of a breast cup panel connected to an opposite breast cup.

28. The bra according to claim 27, wherein each of the crisscrossing straps is coupled to the top portion of an adjacent breast cup panel by use of a ring and to the bottom portion of a breast cup panel connected to an opposite breast cup by stitching.

29. The bra according to claim 27, wherein each of the crisscrossing straps is coupled to the top portion of an adjacent breast cup panel by use of stitching and to the bottom portion of a breast cup panel connected to an opposite breast cup by stitching.

30. The bra according to claim 27, wherein each of the crisscrossing straps is adjustable by use of at least one slider.

31. The bra according to claim 27, wherein each of the crisscrossing straps is adjustable by use of at least one hook and eye set.

32. The bra according to claim 27, wherein each of the crisscrossing straps is adjustable by use of at least one snap.

33. The bra according to claim 27, wherein each of the crisscrossing straps is adjustable by use of at least one button.

34. The bra according to claim 27, wherein each of the crisscrossing straps is adjustable by use of at least one hook.

35. The bra according to claim 27, further comprising a pair of shoulder straps.

36. The bra according to claim 16, wherein each of the crisscrossing straps is adjustable by use of at least one hook.

* * * * *

UNITED STATES PATENT AND TRADEMARK OFFICE

CERTIFICATE OF CORRECTION

PATENT NO. : 8,651,917 B2
APPLICATION NO. : 13/034699
DATED : February 18, 2014
INVENTOR(S) : Lopez et al.

It is certified that error appears in the above-identified patent and that said Letters Patent is hereby corrected as shown below:

In the CLAIMS:

Claim 1, column 5, line 25, delete “the a” and insert --a--.

Claim 16, column 6, line 2, delete “a pair a breast cups” and insert --a pair of breast cups--.

Signed and Sealed this
Eighth Day of July, 2014

Michelle K. Lee

Michelle K. Lee
*Deputy Director of the United States Patent and Trademark Office*